US012484650B2

(12) United States Patent
Sarlin

(10) Patent No.: US 12,484,650 B2
(45) **Date of Patent: *Dec. 2, 2025**

(54) TRANSPARENT FACE PROTECTOR AND INTERCHANGEABLE MOUNT DEVICE

(71) Applicant: BUZZWORKS THINK TANK PTY LTD, Brisbane (AU)

(72) Inventor: Shane Sarlin, Brisbane (AU)

(73) Assignee: BUZZWORKS THINK TANK PTY LTD, Brisbane (AU)

( * ) Notice: Subject to any disclaimer, the term of this patent is extended or adjusted under 35 U.S.C. 154(b) by 0 days.

This patent is subject to a terminal disclaimer.

(21) Appl. No.: 18/416,876

(22) Filed: Jan. 18, 2024

(65) Prior Publication Data

US 2024/0148097 A1 May 9, 2024

Related U.S. Application Data

(63) Continuation of application No. 18/297,600, filed on Apr. 8, 2023, now Pat. No. 11,910,860, which is a continuation of application No. PCT/AU2022/050973, filed on Aug. 24, 2022.

(30) Foreign Application Priority Data

Aug. 24, 2021 (AU) ..... 2021902673

(51) Int. Cl.
*A42B 3/20* (2006.01)

(52) U.S. Cl.
CPC ..... *A42B 3/20* (2013.01)

(58) Field of Classification Search
CPC ..... A42B 3/20; A42B 3/222; A42B 3/228; A42B 3/288
See application file for complete search history.

(56) References Cited

U.S. PATENT DOCUMENTS 2,892,195 A * 6/1959 Monetta ..... A42B 3/326 2/9
2,908,911 A * 10/1959 Sowle ..... A42B 3/20 2/9
3,132,345 A 5/1964 Keith
(Continued)

FOREIGN PATENT DOCUMENTS

KR 102 266 915 B1 6/2021
WO WO-2016057792 A1 * 4/2016 ..... A42B 3/222
(Continued)

*Primary Examiner* — Tajash D Patel
(74) *Attorney, Agent, or Firm* — FULLER IP LAW LLC; Rodney J. Fuller

(57) ABSTRACT

A transparent face protector assembly having a transparent protective mask covering the lower half or lower three quarters of the face, two arms that feature two axis adjustment, a swivel, pivot or hinge and one or more clips to adjust or temporarily adjust the position of the face protector or to open and close the face protector from either the left or the right side, and interchangeable mount devices that attach to the end of the arms to enable secure fitment to helmet ancillary attachment rails and systems. The face protector is attached with interchangeable mount devices that attach to the end of the arms to enable secure fitment to helmet ancillary attachment rails using ARC® or Picatinny® rail systems.

18 Claims, 6 Drawing Sheets

(56) References Cited

U.S. PATENT DOCUMENTS

| | | | | |
|---|---|---|---|---|
| 9,408,430 | B2 * | 8/2016 | Guay | A42B 3/222 |
| 10,136,693 | B1 * | 11/2018 | Paulson | A42B 3/223 |
| 11,910,860 | B2 * | 2/2024 | Sarlin | A42B 3/18 |
| 2015/0026858 | A1 * | 1/2015 | Ross | A42B 3/18 2/2.5 |
| 2015/0135417 | A1 * | 5/2015 | Lebel | A42B 3/326 2/424 |
| 2015/0245682 | A1 * | 9/2015 | McGinn | A42B 3/205 2/424 |
| 2018/0092426 | A1 | 4/2018 | Hall et al. | |

FOREIGN PATENT DOCUMENTS

| | | | | |
|---|---|---|---|---|
| WO | WO-2018087589 | A1 * | 5/2018 | A42B 3/205 |
| WO | WO-2021108924 | A1 * | 6/2021 | A42B 3/20 |

* cited by examiner

TRANSPARENT FACE PROTECTOR AND INTERCHANGEABLE MOUNT DEVICE

CROSS-REFERENCE TO RELATED APPLICATIONS

This application is a Continuation of U.S. patent application Ser. No. 18/297,600, filed Apr. 8, 2023, which is a Continuation of International Patent Application No. PCT/AU2022/050973, filed Aug. 24, 2022, which claims the benefit of and priority to Australian Patent Application No. 2021902673, filed Aug. 24, 2021, the contents of each of which are incorporated herein by reference in their entireties.

BACKGROUND

In military or other situations involving extreme danger, where there might be an elevated risk of projectiles hitting the face causing life changing facial disfigurement, it is desirable to have a face shield to protect the wearer of the helmet. Often times, the face shield adds considerable heat, weight or other discomfort to the wearer. In many situations, the wearer needs to be acutely aware of their surroundings, so visibility is important, even peripheral vision. What is needed is a transparent face protector which provides visibility at least from the wearer's perspective, yet is durable and strong enough to resist impacts that might be encountered in the field.

SUMMARY

In a preferred aspect, the present disclosure sets forth a face protector to shield a face of a wearer. The face protector includes a transparent lower face covering portion, the portion being: an ambidextrous hinge release permitting opening of the facial protection system from either side to access the mouth and nose; opposed vertically adjustable attachment arms configured to position the face covering; an adaptor on one end of each vertical attachment arm configured to engage with a corresponding attachment rail; a horizontal adjustment arm configured to position the face covering to ensure sufficient clearance from the user's face; and a horizontal adjustment arm configured to position the face covering to ensure sufficient clearance from the user's face when wearing a tactical respirator. The lower face covering portion is adjustably fixed to the approximate vertical attachment arms by an attachment means permitting movement of the transparent lower face covering portion through a swivelling motion.

It is to be understood that both the foregoing general description and the following detailed description are exemplary and explanatory only and are not restrictive of the invention, as claimed, unless otherwise stated. In the present specification and claims, the word "comprising" and its derivatives including "comprises" and "comprise" include each of the stated integers, but does not exclude the inclusion of one or more further integers. The claims as filed with this application are hereby incorporated by reference in the description.

The accompanying drawings, which are incorporated in and constitute a part of this specification, illustrate several embodiments of the invention and together with the description, serve to explain the principles of one or more forms of the invention.

DETAILED DESCRIPTION OF THE DRAWINGS

Reference will now be made in detail to the present preferred embodiments of the disclosure, examples of which are illustrated in the accompanying drawings.

Figure 1:
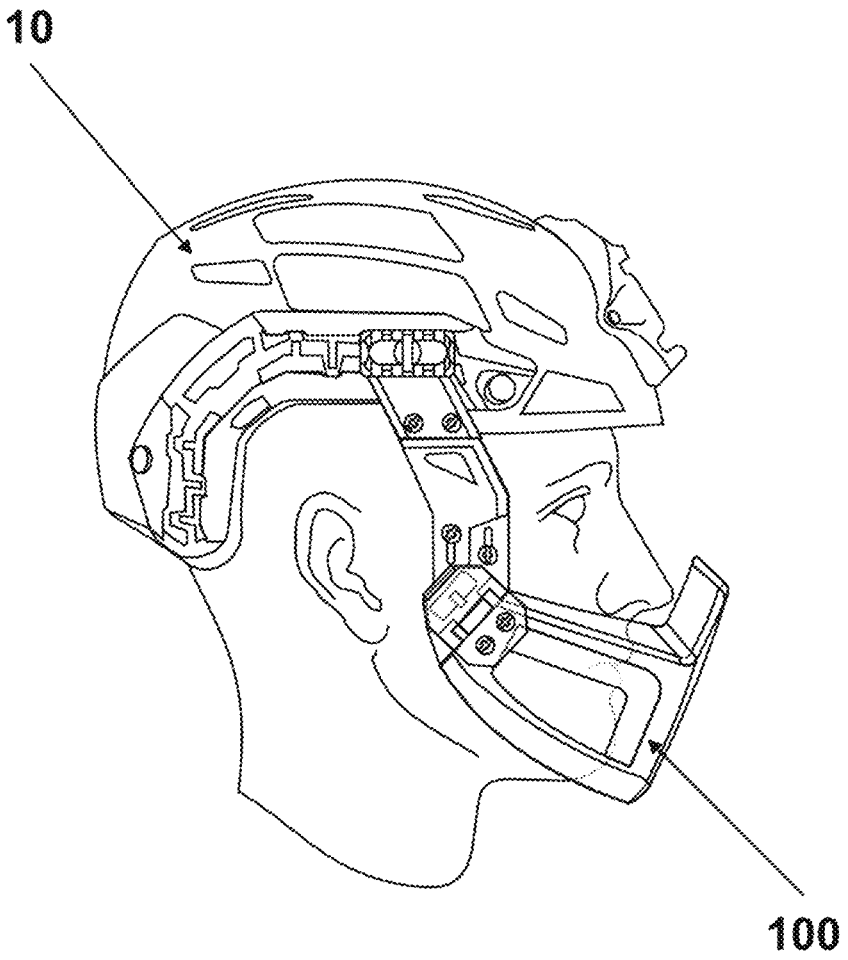
FIG. 1 shows a side view of a face protector mounted to a helmet.
Figure 2:
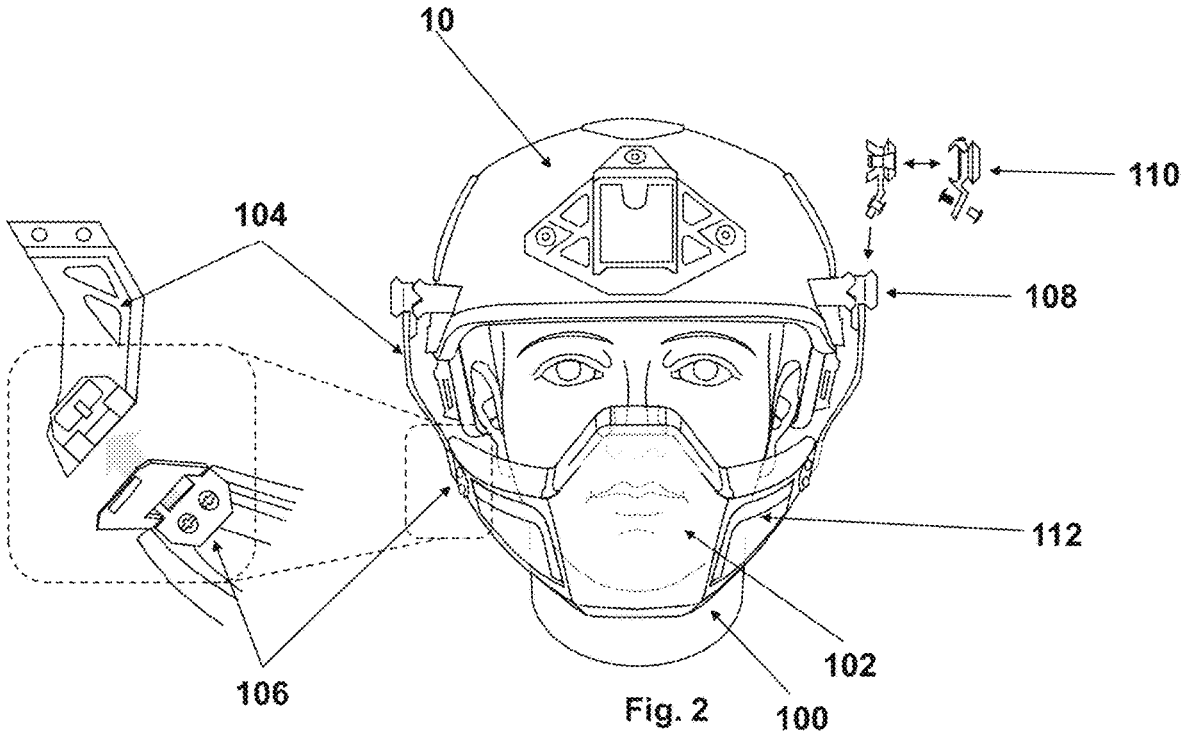
FIG. 2 is a side view of the face protector of FIG. 1, showing anthropomorphic eye movement ranges allowed by the face protector.

FIGS. 1-7 show views of a face protector shield system 100 for attachment to a helmet 10. Protector shield 100 includes a covering portion 102 and arms or rails 104, and a rail adaptor 110. Preferred aspects and features of the protector shield will be further described below. FIGS. 1 and 2 show face protector 100 mounted to helmet 10. Face protector 100 has a lower face covering portion 102 and near vertical attachment arms 104. Face protector 100 covers the lower portion of the face incorporating the mouth and nose of the wearer of the wearer to provide a level of impact protection to the face. The level of impact protection may include laser protection, ballistic protection and/or other inherent protective properties.

Generally vertical attachment arms 104 and generally horizontal attachment arms are preferably made of a heat resistant plastic or hybrid material, such as a carbon fibre-impregnated material, to optimise strength while remaining lightweight.

Figure 3:
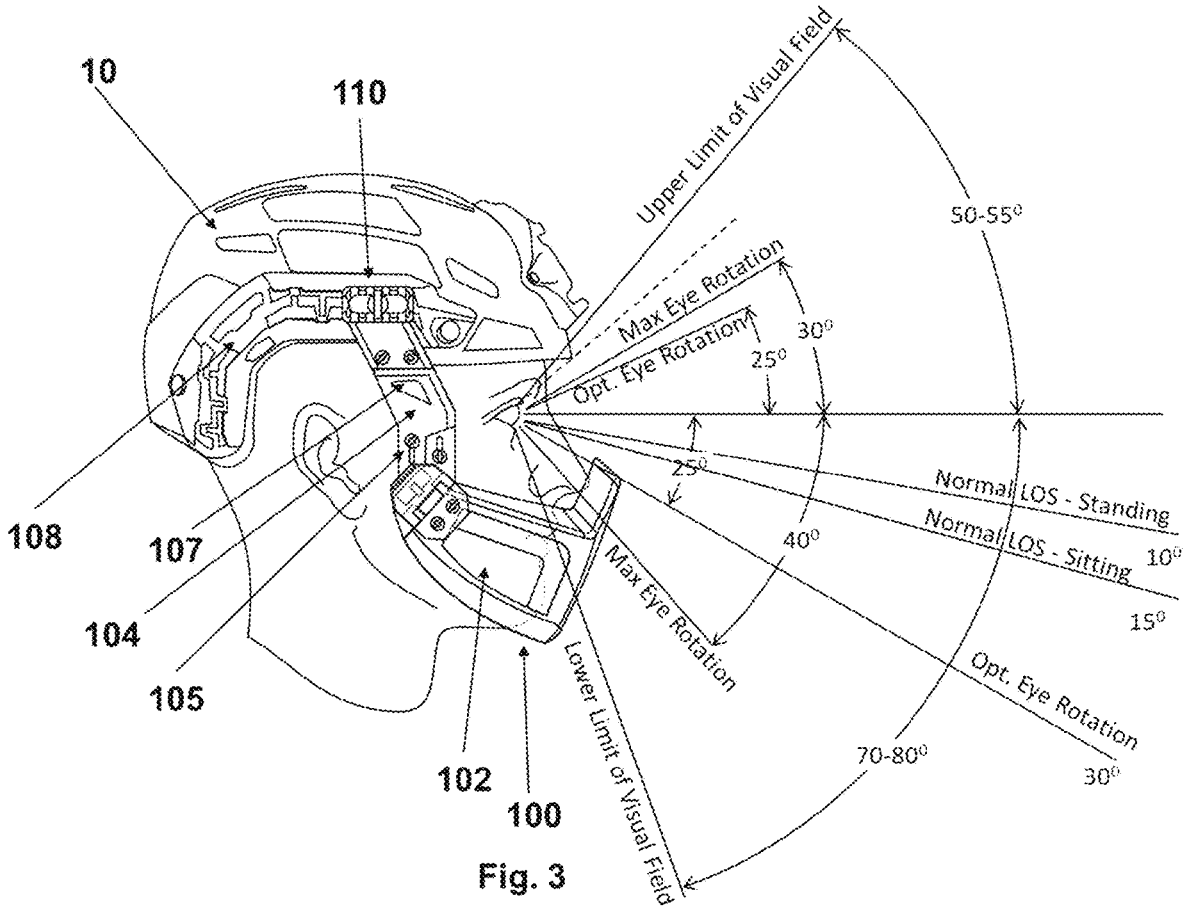
FIG. 3 shows a front view of a face protector and one embodiment of a hinged clasp.

One vertical attachment arm 104 and one horizontal attachment arm may be positioned on each side of the face protector 100 as shown in FIGS. 2 and 3. Each attachment arm 104 is preferably oriented at an angle relative to a horizontal plane, for example, in a range of 30 to 60 degrees, preferably roughly 45 degrees.

Figure 4:
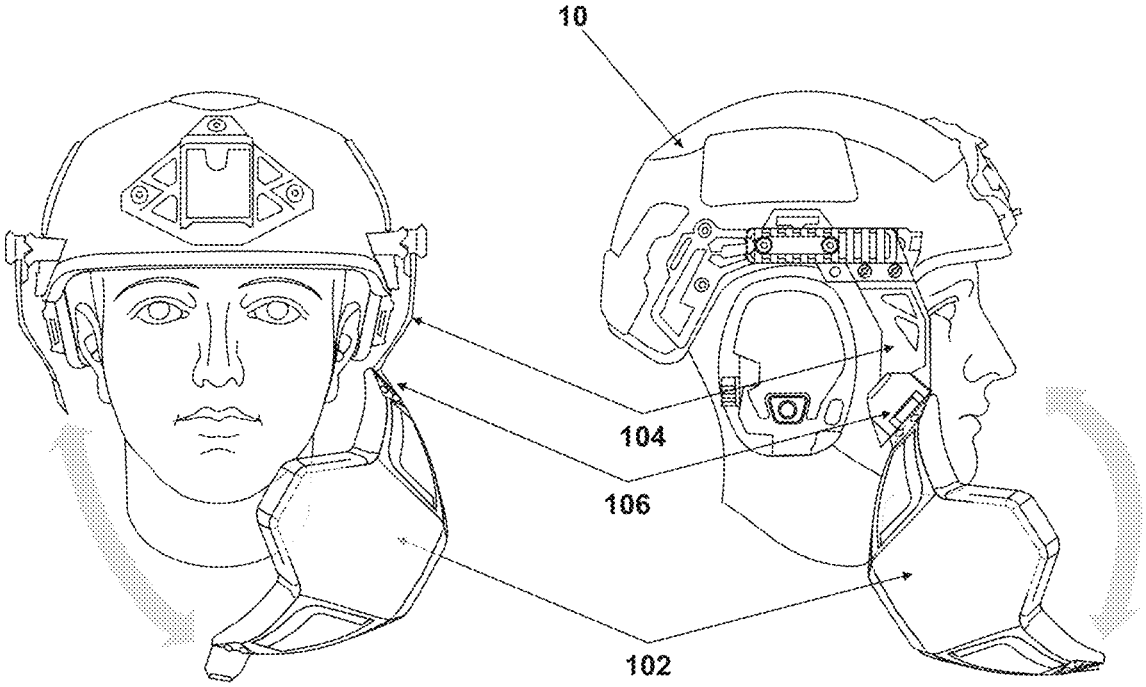
FIG. 4 is a side and front view of the face protector of FIGS. 1 and 3, showing the opening movement allowed by the hinged clasp on the face protector.

Referring to FIG. 4, face protector 100 is connected to the near vertical arm 104 and the horizontal arm with a hinged clasp and clip assembly 106 on a side of the face protector. Assembly 106 is preferably made of a harder material such as a metal, plastic or carbon fibre.

Referring to FIG. 3, clasp 106 may be attachable on both sides of the face protector if desired. Vertical attachment arm 104 may be fitted with a form of vertical adjustment 105 may be a slot to optimally align the vertical height of the face protector to the wearer. Adjustment 105 may allow a range of adjustment between 10 mm to 25 mm, and may be adjusted by vertical rods, screws, interlocking sleeves or other mechanism to enable adjustment. The surface of vertical attachment arm 104 may include vents or channels 107 to provide airflow to the wearer.

Referring to FIGS. 2 and 3, vertical attachment arms 104 and the horizontal attachment arms are configured to engage with corresponding attachment rails 108 on the helmet.

Referring to FIGS. 2, 3, 5, and 6, face protector 100 may affix securely to any helmet fitted with standard attachment rails 108, such as an ARC® or Picatinny® rail or other similar mounting systems, using a multiplicity of adapters 110 suited to different rail systems. Provision may be made for a quick release attachment/detachment to enhance quick disengagement from one helmet to attach to another helmet if desired.

Face protector 100 may be moulded into different shapes to suit different applications, such as a motorcycle helmet, or to integrate with a respirator or filter system to be worn concurrently. For military applications, face protector 100 may include a concave indent 112 (shown in FIG. 2) on both sides to allow the wearer to align their cheek closely to their weapon system to optimally align their eye to a mounted optical sight mounted onto the weapon.

As shown in FIG. 2, the lover face covering portion 102 of face protector 100 is aligned with the midpoint of the helmet when mounted on the attachment rails 104 on the helmet.

Referring to FIG. 3, face protector 100 is shaped and positioned when attached to the helmet to minimise obstruction or occlusion to the lower limit of the visual field. Face protector 100 permits a direct field of view up to 40 degrees below a horizontal plane projecting central to the wearer's eyes. Lower face covering portion 102 of face protector 100 is preferably made of a transparent material. Exemplary materials include, but are not limited to, polycarbonate, or a bullet-proof transparent material. Preferably face protector 100 is made of a material that is light, yet durable.

The transparent material may be between 2 to 5 millimetres in thickness. The height of lower face covering portion 102 between a bottom (chin) to top (covering nose) may be in a range between 7 to 12 cm. It will be appreciated that the dimensions may be varied depending upon the intended wearer size.

The transparent material provides a level of protection without obstructing, minimising or occluding the direct field of view at the lower limit of maximum eye rotation (up to 40° below a horizontal plane projecting central to the wearer's eye). The transparent material is see-through from the wearer's side and may also be see-through from the outside. Alternatively, the face protector may be slightly opaque or translucent, or mirror-like from the observer's view to partially or completely obscure the wearer's identity if desired. The transparent material is preferably scratch-proof. It may be fitted with tear-away clear protective sheets on the outer surface to further protect from scratches, and prolong the life of the transparent face protector. The transparent material preferably has anti-fogging properties, which may include air flow channels or vents to physically prevent fogging.

FIG. 4 shows a side view of the face protector with opening movement permitted by the face protector. Lower face covering portion 102 of face protector 100 is fitted to vertical attachment arms 104 and the horizontal attachment arms with a mechanical or magnetic clasp and clip assembly 106 to enable opening of one or both sides of the face protector to provide unobstructed access to the mouth and nose to enable clear speech, and not interfere with eating.

Either side of lower face covering portion 102 of the face protector may be openable with clasp and clip assembly 106, that preferably incorporates a hinge, and the opposing side of the lower face covering portion 102 of the face protector may be secured with assembly 106 to enable horizontal opening of the face protector to provide unobstructed access to the nose and mouth to enable clear speech and not interfere with eating. This dual clasp, hinge, and clip mechanism advantageously enables one handed opening from either the left or the right side.

Figure 5:
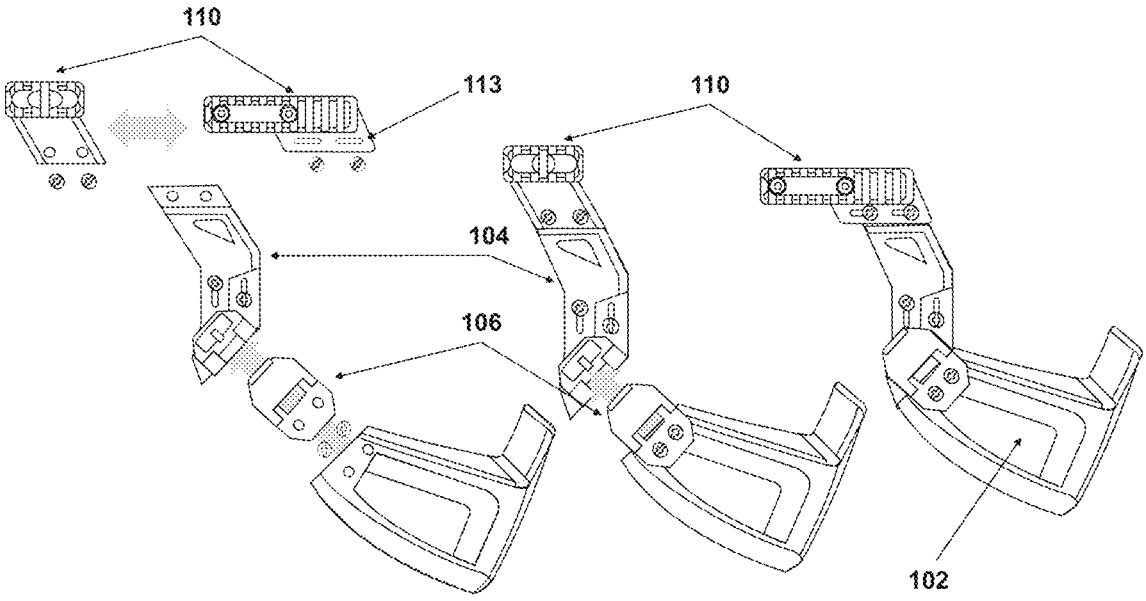
FIG. 5 is a progressive side view of the face protector of FIG. 1, showing a multiplicity of helmet rail adapters and the individual components of the face protector assembly.

FIG. 5 is an exploded view of the components of the face protector, including lower face covering portion 102, adjustable vertical arms 104, a clasp and clip assembly 106 and helmet rail specific adapters 110.

Figure 6:
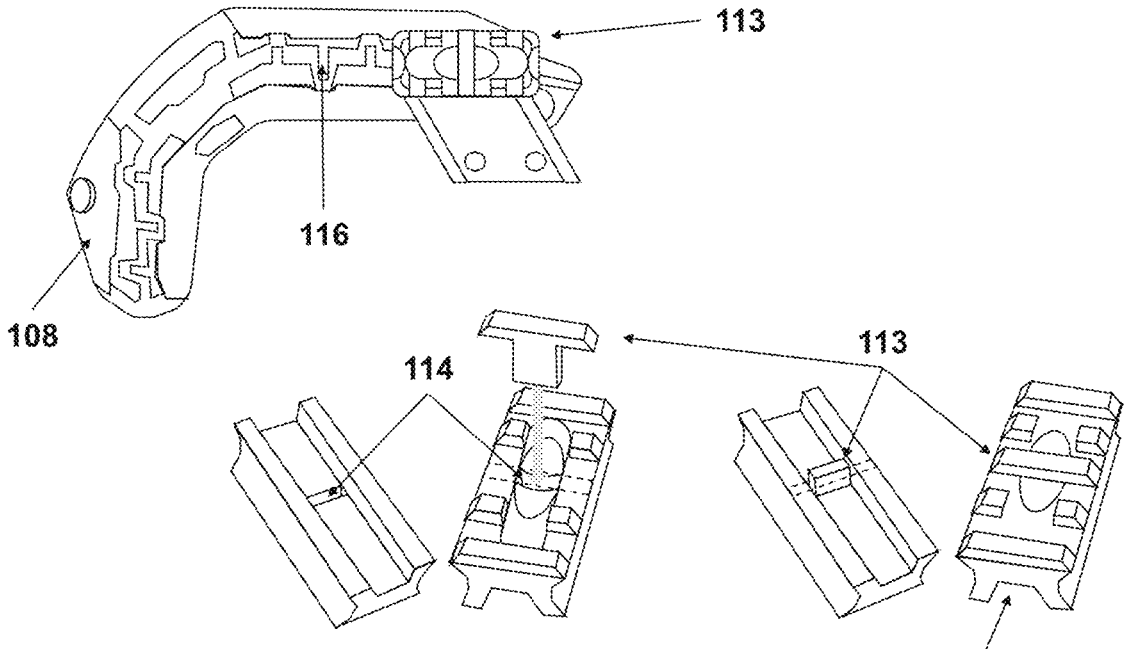
FIG. 6 are progressive side and perspective views of a rail adaptor of FIG. 5.

FIG. 6 shows an embodiment of helmet rail specific adapter 110 to fit an ARC® rail 108. A T-shaped insert 113 fits into detent 114 to secure adaptor 110 into one of retaining slots 116. Rail adaptor 110 permits horizontal frontwards and backwards movement of lower face covering portion 102 away or toward a user's face to provide room for facial hair growth, and to accommodate breathing in cold conditions so as not to cause fogging to a transparent face shield. The attachability and detachability of the various components (e.g., rail adaptors 110 to helmet 10; arms 104 to the rail adaptors 110; and one or both ends of the lower face covering to arms 104) provide a wide range of adjustments and versatility to adapt to a variety of field environments.

Figure 7:
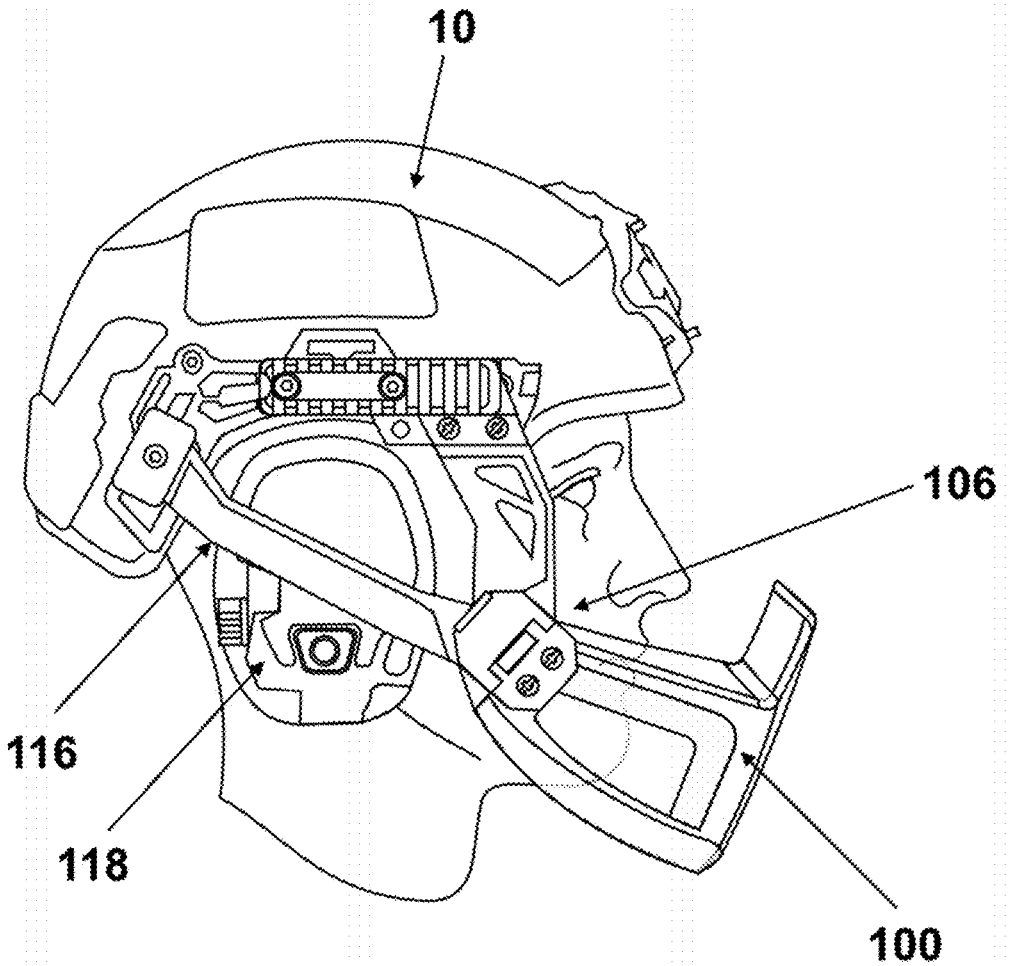
FIG. 7 is a side view of the face protector connected to the helmet on a user.

FIG. 7 is a side view of the face protector of FIG. 1 fitted with a horizontal arm to provide horizontal structural integrity to the system, suitable for use as a motorcycle, bicycle or other helmet system designed to protect the wearer from strong horizontal impact. Horizontal bar 116 is preferably shaped to fit around acoustic hearing protection 118 without physically interacting with it, or interfering with the function of hinged clasp 106 (FIG. 5).

The foregoing description is by way of example only, and may be varied considerably without departing from the scope of the present disclosure. The features described with respect to one embodiment may be applied to other embodiments, or combined with or interchanged with the features of other embodiments, as appropriate, without departing from the scope of the present disclosure.

The present disclosure in a preferred form provides the advantage of being lightweight whilst still highly protective. The present disclosure in a preferred form provides the advantage of being interchangeable between helmets, to suit helmets worn by different users, for different activities. This means the face protector may be used more often than if it was permanently affixed to a helmet designed for a one-sized user, or for one specific purpose (e.g., combat or motorcycle riding). The present disclosure in a preferred form also provides the advantages of anti-scratch and anti-fog properties which are beneficial when the covering portion is transparent. In addition, the present disclosure in a preferred form provides the advantage of being adjustable and moveable, to facilitate clear speech and ability of the user to eat while wearing the helmet. In addition, the present disclosure in a preferred form provides the advantage of being able to be operated by the left or right side by one hand and is therefore suited to both left and right-handed users.

Other embodiments of the disclosure will be apparent to those skilled in the art from consideration of the specification and practice of forms of the embodiments disclosed herein. It is intended that the specification and examples be considered as exemplary only, with a true scope and spirit of the disclosure being indicated by the following claims.

What is claimed is:

1. A face protector to shield a face of a wearer, comprising:

a lower face covering portion, at least a part of which is composed of an optical quality toric or planar surface;

an ambidextrous hinge release permitting opening of the face protector system from either side to access the mouth and nose;

opposed vertically adjustable attachment arms configured to position said face covering;

an adaptor on one end of each vertical attachment arm configured to engage with a corresponding attachment rail, said adaptor enabling horizontal adjustment to position said face covering to ensure sufficient clearance from the user's face when wearing a tactical respirator, where said lower face covering portion is adjustably fixed to said opposed vertical attachment arms by a realeasable swivel permitting movement of the lower face covering portion through a swivelling motion; and a releaseable swivel on each side of the lower face covering portion that enables horizontal opening or removal of the face protector to provide unobstructed access to the nose and mouth.

2. The face protector of claim 1, wherein said lower face covering portion is opaque.

3. The face protector of claim 1, wherein said lower face covering portion is configured to obscure the wearer's identity.

4. The face protector of claim 1, wherein said lower face covering portion is made of a transparent material that is see-through from the wearer's side.

5. The face protector of claim 1, wherein said lower face covering portion is made of a transparent material that is see-through from the wearer's side and from the outside of the wearer.

6. The face protector of claim 1, wherein said lower face covering portion has a scratch resistance feature enhanced by tear away clear protective sheets on the outer surface of the lower face covering portion.

7. The face protector of claim 1, wherein said lower face covering portion has an impact resistance feature that is at laser protection level.

8. The face protector of claim 1, wherein said lower face covering portion has an impact resistance feature that is at ballistic protection level.

9. The face protector of claim 1, wherein said face covering includes a plurality of air flow channels.

10. The face protector of claim 1, wherein said face covering includes a plurality of vents.

11. The face protector of claim 1, wherein said horizontal attachment arm is configured to fit over wearable acoustic hearing protection.

12. The face protector of claim 1, wherein each of said attachment arms is made of a heat resistant plastic and/or hybrid material.

13. The face protector of claim 1, wherein each of said attachment arms is made of carbon fibre impregnated material.

14. The face protector of claim 1, wherein said face protector is configured to permit a direct field of view up to 40 degrees below a horizontal plane projecting central to the wearer's eyes.

15. The face protector of claim 1, wherein the lower face covering portion is between 2 to 5 millimetres in thickness.

16. The face protector of claim 1, where the adaptor includes at least one of slots, notches or detents.

17. The face protector of claim 1, wherein said lower face covering is at least one of scratch resistant, impact resistant, and/or fog resistant.

18. A face protector to shield a face of a wearer, comprising:

a lower face covering portion, at least a part of which is composed of an optical quality toric or planar surface, said lower facer covering portion being mirror-like from an observer's view of the wearer;

an ambidextrous hinge release permitting opening of the face protector system from either side to access the mouth and nose;

opposed vertically adjustable attachment arms configured to position said face covering;

an adaptor on one end of each vertical attachment arm configured to engage with a corresponding attachment rail, said adaptor enabling horizontal adjustment to position said face covering to ensure sufficient clearance from the user's face when wearing a tactical respirator, where said lower face covering portion is adjustably fixed to said opposed vertical attachment arms by a realeasable swivel permitting movement of the lower face covering portion through a swivelling motion; and a releaseable swivel on each side of the lower face covering portion that enables horizontal opening or removal of the face protector to provide unobstructed access to the nose and mouth.

* * * * *